US006582769B2

(12) United States Patent
Crabtree

(10) Patent No.: US 6,582,769 B2
(45) Date of Patent: Jun. 24, 2003

(54) METHOD FOR CONDITIONING A METERING BLADE

(75) Inventor: Richard S. Crabtree, Chillicothe, OH (US)

(73) Assignee: MeadWestvaco Corporation, Stamford, CT (US)

( * ) Notice: Subject to any disclaimer, the term of this patent is extended or adjusted under 35 U.S.C. 154(b) by 0 days.

(21) Appl. No.: 09/996,246

(22) Filed: Nov. 28, 2001

(65) Prior Publication Data

US 2003/0099777 A1 May 29, 2003

(51) Int. Cl.[7] ..... B05D 3/12

(52) U.S. Cl. ..... 427/356; 427/424; 427/434.2; 427/439; 118/104; 118/123; 118/126

(58) Field of Search ..... 427/356, 421, 427/439, 434.2, 424; 118/104, 123, 126; 15/256.5, 256.51

(56) References Cited

U.S. PATENT DOCUMENTS 3,084,663 A 4/1963 Warner
3,152,918 A * 10/1964 Kraus ..... 427/358
3,195,500 A * 7/1965 Kuhnel ..... 118/70
3,299,527 A 1/1967 Doukas
3,843,407 A 10/1974 Thorp
3,868,744 A 3/1975 Thettu
4,026,648 A 5/1977 Takahashi
4,158,498 A 6/1979 Ohmori
4,263,344 A * 4/1981 Radvan et al. ..... 427/150
5,120,365 A * 6/1992 Kogler ..... 106/415
5,219,618 A 6/1993 Daniels
5,474,608 A 12/1995 Beisswanger
5,630,908 A 5/1997 Viertola
5,806,136 A 9/1998 Viertola
6,312,520 B1 * 11/2001 Eriksson et al. ..... 118/106

* cited by examiner

*Primary Examiner*—Katherine A. Bareford
(74) *Attorney, Agent, or Firm*—Thompson Hine LLP

(57) ABSTRACT

A method for conditioning a metering blade of a paper coating machine. The method includes the steps of providing a paper coating machine having at least one metering blade and passing a movable substrate through the paper coating machine such that the metering blade contacts the substrate to distribute any coatings applied to the substrate. The method further includes the step of applying a solution of abrasive material to the substrate at a location upstream of the metering blade such that the abrasive material engages and conditions the blade.

22 Claims, 2 Drawing Sheets

METHOD FOR CONDITIONING A METERING BLADE

The present invention is directed to a method for conditioning a metering blade, and more particularly, to a method for conditioning a metering blade using a solution of abrasive particles.

BACKGROUND OF THE INVENTION

In order to manufacture coated papers, a paper substrate is typically provided, and a coating is then deposited, in a liquid state, onto the substrate. The coated substrate is then passed underneath a doctor or blade or series of doctors or blades which remove extraneous coating material from the coated substrate and smooth, spread and distribute the coating on the substrate. The coated substrate is then dried or cured, and may then be wound around a take-up reel and shipped to a customer for further processing.

When the coated substrate passes underneath the blades, the blades may create a series of visible lines on the coating in the machine direction. In particular, when debris from the paper manufacturing or coating process is captured between the nip of the blade and the coated substrate, the debris can cause such lines (known as "blade lines") or other defects on the coated substrate. Furthermore, when new blades are used in the coating process, the blades may not be precisely calibrated or shaped which can also cause blade lines to be formed on the coated substrate.

Blade lines have attempted to be eliminated by changing the formulation of the coating. For example, the coating may be diluted to ensure that the coating is still in a fluid state and has not yet begun to harden when the coated substrate passes underneath the blades. However, diluting the coating may increase manufacturing time (due to the increased time required to cure the coating) and may increase the roughness of the paper coating.

Accordingly, there is a need for a method for conditioning a metering blade to reduce the presence of coating blade lines.

SUMMARY OF THE INVENTION

The present invention is a method for conditioning a metering blade through the use of abrasive particles or an abrasive solution to reduce the presence of coating blade lines. In one embodiment, the invention is a method for conditioning a metering blade of a paper coating machine. The method includes the steps of providing a paper coating machine having at least one metering blade and passing a movable substrate through the paper coating machine such that the metering blade contacts the substrate to distribute any coatings applied to the substrate. The method further includes the step of applying a solution of abrasive material to the substrate at a location upstream of the metering blade such that the abrasive material engages and conditions the blade. Other objects and advantages of the present invention will be apparent from the following description and the accompanying drawings.

DETAILED DESCRIPTION

Figure 1:
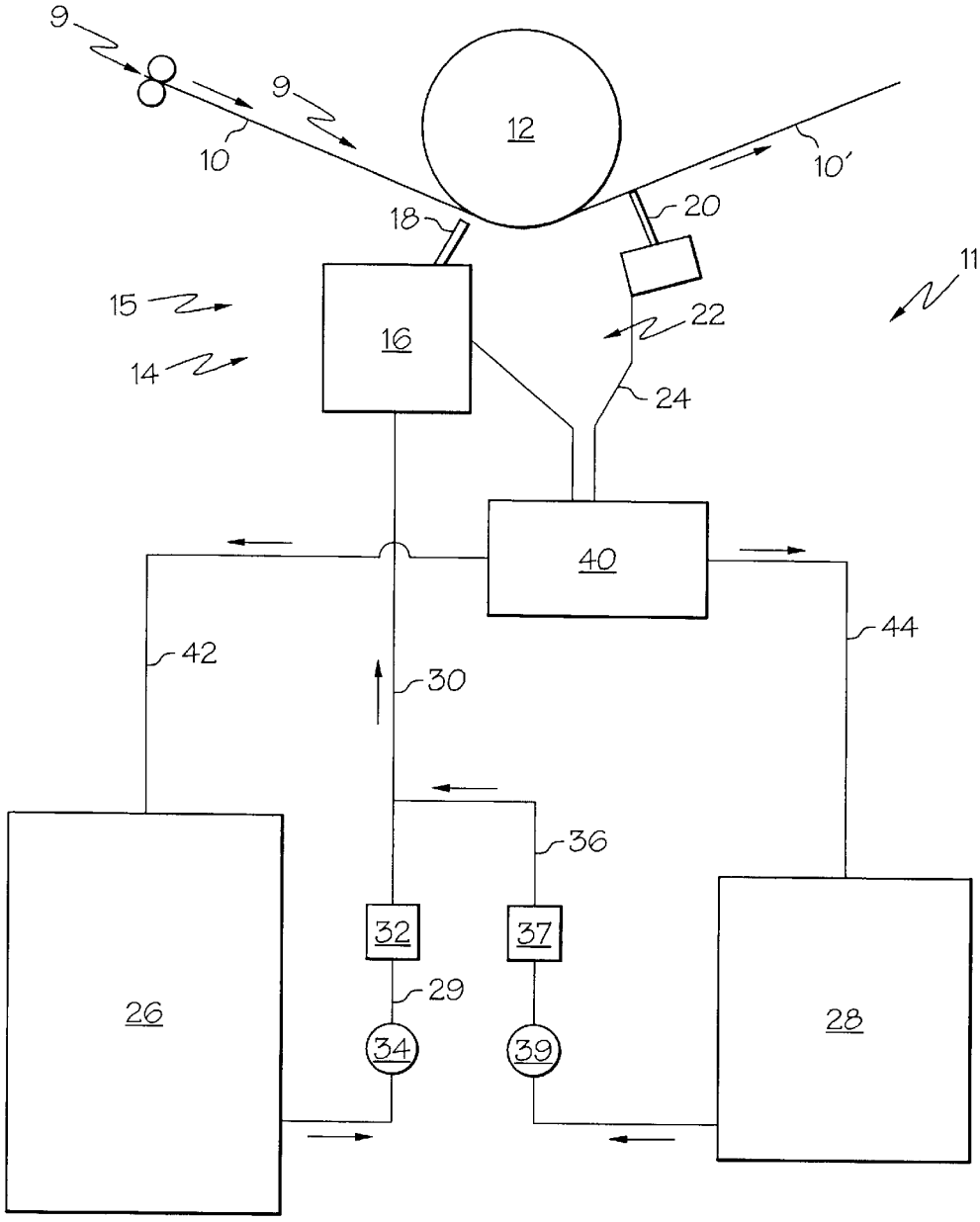
FIG. 1 is a schematic representation of one embodiment of the method of the present invention, used with a jet coating system.

As shown in FIG. 1, the present invention is a system 11 that may be used to apply a coating to a substrate 10. The system 11 may be located in or be part of a paper coating machine which includes a feed path 9 for receiving the substrate 10 therethrough. In a typical coating process, the substrate 10 is passed around a backing roll 12, and a desired coating is applied to the substrate 10 at an application station 15. The substrate 10 can be any of a variety of materials, such as paper. The application station 15 may include a jet applicator 14 which includes a jet reservoir 16 and a nozzle 18 that can spray the coating from the jet reservoir 16 onto the substrate 10. After the coating is applied to the substrate 10, the substrate 10 is passed about the roll 12 and moved in a downstream direction indicated by the arrows of FIG. 1. The substrate 10 is then passed under a metering blade or blades 20, which removes any extra coating from the substrate 10 and spreads the coating evenly across the substrate 10. Any coating that is scraped away by the metering blades 20 falls into a catch cavity 22 and is captured in a catch pan 24 located below the blades 20. The substrate 10 is then passed downstream for further processing.

The system 11 includes a primary coating tank 26 and a secondary coating tank 28, each tank 26 and 28 being coupled to the jet reservoir 16. The primary coating tank 26 is coupled to the jet reservoir by a primary supply line 29 and a common supply line 30. The primary supply line 29 may include a filter 32 and pump 34 located therein. The secondary coating tank 28 is coupled to the jet reservoir 16 by a secondary supply line 36 and the common supply line 30. The secondary supply line 36 may include a filter 37 and pump 39 located therein. Although various pumps may be used, the pumps 34, 39 are preferably positive displacement pumps.

The primary coating tank 26 stores the primary coating that is desired to be deposited on the substrate 10. The primary coating can be nearly any desired material which is desired to be coated on the substrate 10, such as, but not limited to, pigmented coatings, mineral coatings, and coatings including clay or calcium carbonate, binders, pigments, lubricants, cross linkers, dispersants, and/or other additives to form a glossy, dull, or matte coating.

During normal operation, the pump 34 is activated to supply the primary coating from the primary coating supply tank 26 and through the filter 34. The primary coating is then introduced into the jet reservoir 16 via the primary supply line 29 and common supply line 30. The primary coating is then sprayed from the jet reservoir 16 onto the substrate 10 by the nozzle 18.

The coated substrate is then fed downstream and the coating is metered by the blade 20. The extra coating that is removed by the blades 20 is captured in the catch pan 24 and fed to the return valve 40. During normal operations, the return valve 40 returns the removed primary coating to the primary coating supply tank 26 via a primary coating return line 42.

The system 11 of the present invention may include the secondary coating tank 28 which stores a secondary coating, such as a solution of abrasive material therein, although nearly any solution which provides the desired abrasive properties and conditioning effects described below may be used. For example, in one embodiment the abrasive solution may include coarse ground carbonate particles having an average particle size of about 0.1 to about 10 microns, preferably about 2 to about 6 microns, suspended in a water solution. The abrasive solution may include a percentage of solids of between about 5% to about 80%, preferably between about 50% to about 70%. The solids suspended in the liquid solution may include pigments (such as clay and the abrasive particles), binders (such as latex and starch), and additives (such as lubricants). The total parts of the binder to parts pigment may be about 5–30. The binder may also constitute about 4% to 26% of the total weight of the solids. The parts of the abrasive particles to total pigment may be between about 5 to 100 parts. The abrasive particles may constitute between about 4% to about 100% of the pigment, by weight. The abrasive particles may constitute between about 4% to about 90% of the total weight of the solids. As will be discussed in greater detail below, the amount of abrasive particles in the solution is preferably sufficient to pull any debris from between the nip of the substrate 10 and blade 20 without causing undo wear upon the blades.

The secondary coating can be supplied to the application station 15 when it is desired to condition the metering blades 20. For example, when an operator switches to new metering blades or when it is noticed that blade lines are present on the coated substrate 10', the secondary coating may be applied to the substrate 10 to condition the metering blades 20 in the desired manner. It is expected that any portions of the substrate 10 which include the secondary coating thereon may be discarded. Although the conditioning method of the present invention may be most beneficial for smooth substrates, the invention can be used with nearly any substrate or coating process, regardless of the roughness of the substrate.

In order to supply the secondary coating to the application station 15, pump 39 is activated to supply the secondary coating from the secondary tank 28 to the jet reservoir 16 via the secondary supply line 36 and common supply line 30. The nozzle 18 then sprays the secondary coating onto the substrate 10. In this manner, when the secondary coating is applied to the substrate 10, the secondary coating helps to clean the blades 20 and remove any debris trapped underneath the blades 20. In other words, the secondary coating pushes any material or debris that is trapped between the nip of the blades 20 and the substrate 10 through the nip. Furthermore, the secondary coating helps to "wear in" or condition new metering blades. Although the system of FIG. 1 illustrates one system for applying an abrasive solution to the substrate 10, it should be understood that any of a wide variety of manner of applying the secondary coating to the substrate 10 may be used without departing from the scope of the present invention.

As noted earlier, during normal operations the primary coating is supplied from the primary supply tank 36 to the jet reservoir 16 via pump 34, and then applied to the substrate 10 at the application station 15. When it is desired to condition the blades 20, the pump 34 is preferably turned off or gradually ramped down while the pump 39 is simultaneously activated or gradually ramped up to pass the secondary coating through the common supply line 30. The pumps 34, 39 are preferably controlled so that the flow rate of fluid through the common supply line 30 and applied at the application station 15 remains constant during the switchover to the secondary coating. Furthermore, as soon as any secondary coating is applied to the substrate 10, the coating return valve 40 may be switched over such that any fluids caught by the catch pan 40 are routed to the secondary coating supply tank 28 via a secondary coating return line 44.

The pumps 34, 39 are preferably controlled such that.the percentage of flow in the common supply line 30 and applied at the application station 15 contributed from the primary coating supply tank 26 is gradually reduced while the percentage of flow in the common supply line 30 and applied at the application station 15 contributed from the secondary coating supply tank 28 is gradually increased. In this manner, the secondary and primary coating are at least partially co-mingled in the common supply line 30 during the "phasing in" and "phasing out" stages of the secondary coating. The "phase in" step is preferably a linear phase in of the secondary coating and may take place over any desired length of time, such as, for example, 45 seconds. Once the fluids in the common supply line 30 and sprayed by the nozzle 18 consists 100% of the secondary coating, the secondary coating is then applied to the substrate 10 for the desired period of time, for example, from about 0 to about 3 minutes or more. Alternately, if the system 11 is being operated from a start-up condition, the "phase in" step may be bypassed, and the conditioning operations may commence by supplying the entire coating from the secondary coating supply tank 28.

Next, the "phase out" of the secondary coating is initiated. The phase out may be accomplished by controlling the pumps 34, 39 such that the percentage of secondary coating in the flow in the common supply line 30 and sprayed by the nozzle 18 is gradually decreased (preferably linearly) while the percentage of the primary coating is simultaneously increased (preferably linearly). Once the supply of the secondary coating reaches 0% of the flow in the common supply line 30 and nozzle 18, the pump 39 may be turned off, and the coating return valve 40 is switched such that any fluids caught by the catch pan 24 are routed to the primary coating supply tank 26 via the primary coating return line 42. The "phase out" operation may be as long as desired, for example, 45 seconds.

Both the "phase in" and "phase out" procedures are preferably controlled to maintain the percentage of solids and viscosity of the fluids sprayed onto the substrate 10 at a generally constant level. It is desired to maintain the deposited coat weight at a constant or close to constant level to avoid overloading the systems and to avoid any web breaks. Furthermore, it is not necessary that the secondary coating be the only fluid sprayed onto the substrate 10. In other words, a solution of the secondary coating and the primary coating may be sufficient to condition the blades 20.

Figure 2:
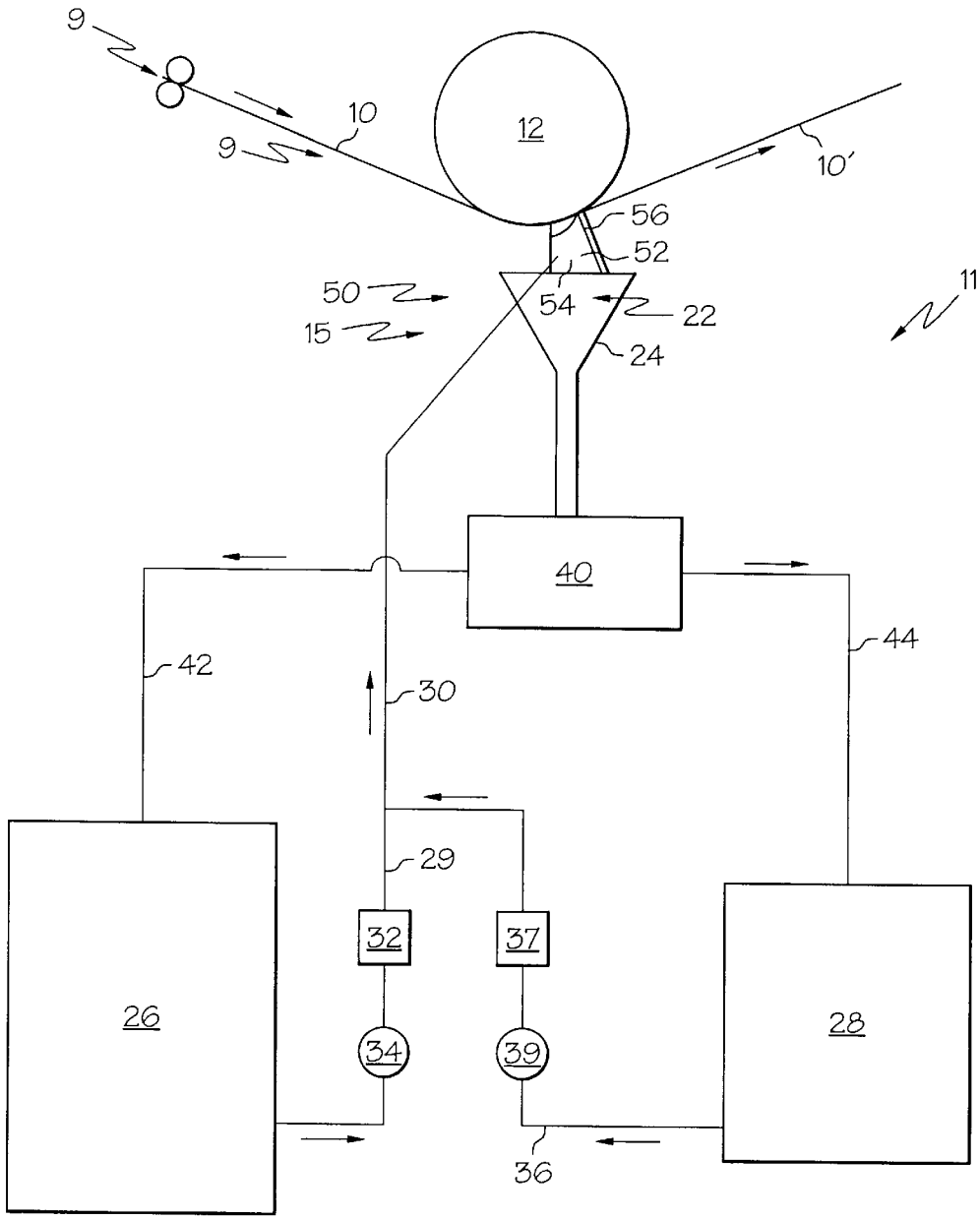
FIG. 2 is a schematic representation of one embodiment of the method of the present invention, used with a short dwell system.

FIG. 2 illustrates the system 11 of the present invention wherein the application station 15 includes a short dwell applicator 50. In this case, the substrate 10 is passed through or immersed in a bath 52 containing the coating to be applied 54, and the blades 56 remove any extra coating 54 and evenly distribute the coating 54 on the substrate. The system and method of the present invention may also be used with a combination dwell or jet-type applicators. Furthermore, the system and method of the present invention are not limited to use with dwell or jet-type applicators, and can be used with nearly any method or mechanism for applying a coating to a substrate.

Having described the invention in detail and by reference to the preferred embodiments, it will be apparent that modifications and variations thereof are possible without departing from the scope of the invention.

What is claimed is:

1. A method for conditioning a metering blade of a coating machine comprising the steps of:

providing a coating machine having at least one metering blade;

passing a movable substrate through said coating machine such that said metering blade contacts said substrate to distribute a coating applied to said substrate;

applying a solution of abrasive material to said substrate at a location upstream of said metering blade such that said abrasive material engages and conditions said blade by abrading said blade, or cleaning debris off of said blade, or removing debris trapped between said blade and said substrate; and phasing out the application of said solution of abrasive material and phasing in an application of a primary coating to said substrate at a location upstream of said metering blade.

2. The method of claim 1 wherein said solution of abrasive material and said primary coating are both applied by either spraying said solution or said primary coating onto said substrate or immersing said substrate in a bath of said solution or said primary coating.

3. The method of claim 1 wherein said phasing out and phasing in steps at least partially overlap.

4. The method of claim 3 wherein said phasing in and phasing out steps are controlled such that the combined weight of the solution of abrasive material and the primary coating applied to said substrate remains generally constant during said phasing in and phasing out steps.

5. The method of claim 3 wherein said solution of abrasive material and said primary coating are at least partially commingled during said phasing in and said phasing out steps.

6. The method of claim 1 wherein applying step is carried out for about 10 seconds to about 3 minutes, and wherein said phasing out step is carried out for less than about 3 minutes.

7. The method of claim 1 wherein said primary coating is selected from a group consisting of: a pigmented coating, a mineral coating, a calcium carbonate coating, a clay coating, a glossy coating, a dull coating, and a matte coating.

8. The method of claim 1 further comprising the steps of allowing said coating to cure and winding said substrate with said cured coating thereon onto a take-up reel.

9. The method of claim 1 wherein said solution of abrasive material includes particles having an average size of about 2–6 microns suspended in a liquid base.

10. The method of claim 9 wherein said particles are ground carbonate and said liquid base is water.

11. The method of claim 1 wherein said coating machine includes a backing roll, and wherein said substrate is passed around a backing roll during said applying step.

12. The method of claim 1 further comprising the step of applying said primary coating to said substrate while not applying any of said abrasive solution.

13. The method of claim 1 wherein said substrate is paper.

14. The method of claim 1 wherein said applying step includes spraying said abrasive material onto said substrate.

15. The method of claim 1 wherein said applying step includes passing said substrate through a bath of said abrasive material.

16. The method of claim 1 wherein said solution of abrasive material includes a binder and a pigment including about 4% to about 100% of said abrasive particles, by weight.

17. The method of claim 1 wherein said primary coating is substantially less abrasive then said abrasive material.

18. A method for conditioning a metering blade of a coating machine comprising the steps of:

providing a coating machine having at least one metering blade;

passing a movable substrate through said coating machine such that said metering blade contacts said substrate to distribute a coating applied to said substrate;

applying a primary coat to said substrate;

applying a solution of abrasive material to said substrate at a location upstream of said metering blade such that said abrasive material engages and conditions said blade by abrading said blade, or cleaning debris off of said blade, or removing debris trapped between said blade and said substrate; and phasing out the application of said primary coat while simultaneously phasing in the application of said solution of abrasive material.

19. A method for forming a coating on a substrate using a coating apparatus including a metering blade for engaging said substrate and distributing a coating applied to said substrate, the method comprising the steps of:

applying a fonnulation to said substrate, wherein said formulation includes sufficient levels of an abrasive material component to clean debris off of said metering blade or abrade said blade, or remove debris trapped between said blade and said substrate;

causing said metering blade to engage said substrate such that said formulation cleans debris off of said metering blade, or abrades said blade, or removes debris trapped between said blade and said substrate; and adjusting the level of said formulation to decrease the level of said abrasive material component and simultaneously increase the level of a coating component of said formulation until said formulation essentially does not include any of said abrasive material.

20. The method of claim 19 wherein said adjusting step includes controlling the application of said formulation such that the weight of the said formulation applied to said substrate remains generally constant.

21. A method for forming a coating on a substrate with reduced blade lines using a coating apparatus including a metering blade for engaging said substrate and distributing a coating applied to said substrate, the method comprising the steps of:

applying a formulation to said substrate, wherein said formulation includes an abrasive material component and a coating component, and wherein said formulation includes sufficient levels of said abrasive material component such that said abrasive material can remove debris trapped between said metering blade and said substrate, or abrade said blade, or clean debris off of said blade;

causing said metering blade to engage said substrate such that said formulation removes debris trapped between said metering blade and said substrate, or abrades said blade, or cleans debris off of said blade; and reducing the level of said abrasive material component of said formulation while simultaneously increasing the level of said coating component.

22. The method of claim 21 wherein said reducing step includes reducing the level of said abrasive material of said formulation until said formulation includes generally does not include any of said abrasive material component.

* * * * *

UNITED STATES PATENT AND TRADEMARK OFFICE

CERTIFICATE OF CORRECTION

PATENT NO. : 6,582,769 B2
DATED : June 24, 2003
INVENTOR(S) : Richard S. Crabtree It is certified that error appears in the above-identified patent and that said Letters Patent is hereby corrected as shown below:

Column 6,
Line 20, the word "fonnulation" should be -- formulation --.

Signed and Sealed this

Nineteenth Day of August, 2003

JAMES E. ROGAN
*Director of the United States Patent and Trademark Office*